US007042433B1

(12) United States Patent
Kubota et al.

(10) Patent No.: US 7,042,433 B1
(45) Date of Patent: May 9, 2006

(54) SIGNAL LINE DRIVING CIRCUIT AND IMAGE DISPLAY DEVICE

(75) Inventors: Yasushi Kubota, Sakurai (JP); Hajime Washio, Tenri (JP); Kazuhiro Maeda, Tenri (JP); Graham Andrew Cairns, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/567,364

(22) Filed: May 9, 2000

(30) Foreign Application Priority Data

May 14, 1999 (JP) ..... 11-134592

(51) Int. Cl.
*G09G 3/36* (2006.01)

(52) U.S. Cl. ..... 345/100; 345/98; 345/204

(58) Field of Classification Search ..... 345/55–104, 345/204–205; 349/41–48; 377/54, 64, 69–79, 377/81

See application file for complete search history.

(56) References Cited

U.S. PATENT DOCUMENTS

| | | | | |
|---|---|---|---|---|
| 4,785,297 A | | 11/1988 | Sekiya | 340/784 |
| 5,159,323 A | * | 10/1992 | Mase et al. | 340/706 |
| 5,250,931 A | * | 10/1993 | Misawa et al. | 345/206 |
| 5,414,443 A | * | 5/1995 | Kanatani et al. | 345/95 |
| 5,434,599 A | * | 7/1995 | Hirai et al. | 345/100 |
| 5,619,225 A | * | 4/1997 | Hashimoto | 345/98 |
| 5,699,074 A | * | 12/1997 | Sutherland et al. | 345/90 |
| 5,754,155 A | * | 5/1998 | Kubota et al. | 345/98 |
| 5,808,595 A | | 9/1998 | Kubota et al. | 345/92 |
| 5,815,129 A | | 9/1998 | Jung | 345/93 |
| 5,896,115 A | * | 4/1999 | Yano et al. | 345/74.1 |
| 6,377,235 B1 | * | 4/2002 | Murade et al. | 345/100 |

FOREIGN PATENT DOCUMENTS

| | | | |
|---|---|---|---|
| EP | 0 433 054 A2 | | 6/1991 |
| EP | 0 730 258 A1 | | 9/1996 |
| JP | 61-245139 | | 10/1986 |
| JP | 2-082295 | * | 3/1990 |
| JP | 7-168154 | | 7/1995 |
| JP | 9-182004 | | 7/1997 |
| JP | 10-090650 | | 4/1998 |
| JP | 11-085111 | | 3/1999 |
| JP | 11-109926 | * | 4/1999 |

* cited by examiner (Continued)

*Primary Examiner*—Lun-Yi Lao
(74) *Attorney, Agent, or Firm*—John J. Penny, Jr.; David G. Conlin; Edwards Angell Palmer & Dodge, LLP

(57) ABSTRACT

A signal line driving circuit includes a shift register having a plurality of shift circuits, each of which shifts a start pulse successively to the next stage, synchronizing with the timing of a clock signal. In this signal line driving circuit, shift pulses are outputted from an AND gate based on output pulses of two adjacent shift circuits. Meanwhile, a width specifying pulse for specifying a pulse width of the shift pulse is inputted via a transistor whose ON/OFF operation is controlled by the shift pulse. A logical operation circuit operates an AND of the shift pulse and the width specifying pulse and outputs the result of operation to a signal line. When the shift pulse is non-active, the transistor becomes OFF, which causes the signal line transmitting the width specifying pulse to be disconnected from the signal line driving circuit, thereby reducing a capacitive load of wiring. As a result, reduction of a parasitic capacitance of the wiring, reduction in the number of elements, reduction in the size of an amplitude of an input signal, etc. in the signal line driving circuit are attained.

6 Claims, 14 Drawing Sheets

CKG
SPG
GPS
SR
SR
SR
SR
11
11a
11a
11a
11a
11b
11b
11b
11b
GN1
GN2
GN3
GN4
13
13
13
13
CIR
CIR
CIR
CIR
14
14
14
14
15
15
15
15
GO1
GO2
GO3
GO4
GL1
GL2
GL3
GL4

SIGNAL LINE DRIVING CIRCUIT AND IMAGE DISPLAY DEVICE

FIELD OF THE INVENTION

The present invention relates to a signal line driving circuit that drives signal lines so as to supply signals to their destinations, and particularly to a simplification of a driving circuit used in image display devices, and in particular liquid crystal display devices.

BACKGROUND OF THE INVENTION

A signal line driving circuit of the present invention is applicable to a variety of systems. The following will describe the case where the signal line driving circuit is applied to an image display device, and in particular to an active-matrix type liquid crystal display device. However, the signal line driving circuit according to the present invention is not just limited to this, and evidently, it is equally effective in the other image display devices or systems, wherein the present invention is applicable.

As a kind of conventional image display devices, liquid crystal display devices of an active-matrix driving system are known. As shown in FIG. 10, the liquid crystal display device includes a pixel array 1, a scanning signal line driving circuit 2 and a data signal line driving circuit 3. The pixel array 1 includes scanning signal lines GL ($GL_j$, $GL_{j+1}$) and data signal lines SL ($SL_i$, $SL_{i+1}$) crossing one another, and pixel (PIX, as illustrated in FIG. 10) 4 which is arranged in matrix. The pixel 4 is formed within each area enclosed by two adjacent scanning signal lines GL and two adjacent data signal lines SL.

The data signal line driving circuit 3 makes sampling of a received video signal DAT (data) in synchronism with a timing signal such as a clock signal CKS, and amplifies it as required, and outputs it into each data signal line SL. The scanning signal line driving circuit 2 successively selects the scanning signal line GL in synchronism with a timing signal such as a clock signal CKG, and by controlling opening and closing of a switching element (described later) within pixel 4, applies the video signal DAT which was outputted to each data signal line SL to each pixel 4, and stores the video signal DAT on each pixel 4.

The pixel 4, as shown in FIG. 11, is composed of a pixel transistor SW (electric field effect transistor) as the switching element, and a pixel capacitance $C_P$ including a liquid crystal capacitance $C_L$ (auxiliary capacitance $C_S$ is added as required). In the pixel 4 having this arrangement, the data signal line SL is connected to one of the electrodes of the pixel capacitance $C_P$ via a drain and source of the pixel transistor SW, the gate of the pixel transistor SW is connected to the scanning signal line GL, and the other electrode of the pixel capacitance $C_P$ is connected to a common electrode line which is common to all pixels (not shown). With this arrangement, when a voltage is applied to the liquid crystal capacitance $C_L$ of the pixel capacitance $C_P$, the transmittance or reflectance of the liquid crystal is modulated, and a picture in accordance with the video signal DAT is displayed on the pixel array 1.

The following will explain how the video signal DAT is outputted into the data signal line SL by the data signal line driving circuit 3. Although driving modes for the data signal line SL include a point-sequential driving mode and a line-sequential driving mode, merely the latter will be discussed below.

The scanning signal line driving circuit 2 is, as illustrated in FIG. 12 for example, provided with a shift register 101 which transfers start pulses SPG successively at the timing of the clock signal CKG. In this scanning signal line driving circuit 2, a shift pulse $GN_n$ (n=1, 2), which is an AND of output signals of two adjacent shift circuits 101*a*, are outputted from an AND gate 101*b*, and the shift pulse $GN_n$ thus outputted and a width specifying pulse GPS, which is externally inputted so as to specify the pulse length of the shift pulse $GN_n$, are subjected to logical AND by an AND gate 103, and a pulse of the logical AND thus obtained is outputted to a scanning signal line $GL_n$ via a buffer circuit 104.

In the foregoing scanning signal line driving circuit 2, the AND gate 103 that outputs the AND of the shift pulse $GN_n$ and the width specifying pulse GPS, as shown in FIG. 13, is realized by a common CMOS AND circuit (CMOS OR circuit when the input signal is a negative logic). This CMOS AND circuit is composed of two p-channel transistors 111 and 112 which are connected in parallel, and two n-channel transistors 113 and 114 serially connected to the p-channel transistors 111 and 112. The gates of the p-channel transistor 111 and the n-channel transistor 113 receive an input signal $IN_1$, and the gates of the p-channel transistor 112 and the n-channel transistor 114 receive an input signal $IN_2$. The amplitudes of these input signals $IN_1$ and $IN_2$ are equal to that of a power voltage $V_{DD}$.

Further, in recent years, a technique which forms the scanning signal line driving circuit 2 and the data signal line driving circuit 3 on a substrate 5 integrally with the pixel array 1 has been focussed, so as to achieve miniatualization of image display devices, enhance reliability, reduce costs, etc. In such driving circuits integrated with the pixel array 1, as with the latest ICs, techniques for attaining lower input voltages (smaller amplitudes), aiming at reduction of power consumption and achievement of high-speed performance and the like, have been developed. However, in a driving circuit, the use of a voltage higher than an input voltage is required so as to obtain a predetermined driving power. Accordingly, as shown in FIG. 14, the scanning signal line driving circuit 2 includes a level shifter (LS, as illustrated in Figures) 105 which raises the width specifying pulse GPS of a small amplitude.

In recent years, to achieve lower power consumption of liquid crystal display devices, and higher operation speed and the like, demands have increased as to the lower load of internal wiring (reduction of parasitic capacitance) and the miniatualization of driving circuits so as to reduce a periphery portion (edge portion) where the driving circuits are to be provided, i.e. to reduce the number of elements composing the driving circuits. Accordingly, in the foregoing scanning signal line driving circuit 2, it is required to realize a circuit structure which is capable of a higher-speed operation, which has the less parasitic capacitance, and which has a smaller number of elements, in comparison with the CMOS AND circuit forming the AND gate 103.

However, in the scanning signal line driving circuit 2, because the level shifter 105 is provided at the input section of the signal line which transmits the width specifying pulse GPS, the GPS whose amplitude has been increased by the level shifter 105 is supplied to each AND gate 103 via signal lines. This is one of the factors that causes the increase in power consumption in the signal line driving circuits.

SUMMARY OF THE INVENTION

An object of the present invention is to provide (i) a signal line driving circuit which can reduce parasitic capacitance of wiring and the number of elements, and miniatualize an amplitude of an input signal; and (ii) a low-power-consumption-type image display device which affords a broader operation margin and which can reduce a burden of an external interface, by having such a signal line driving circuit.

In order to attain this object, a signal line driving circuit in accordance with the present invention outputs an output pulse to a plurality of output lines, which includes:

(a) a shift register having a plurality of serially connected shift circuits each of which shifts an input pulse successively to the next stage based on a clock signal; and (b) a switching element for outputting a shift pulse only in an output duration of a width specifying pulse which specifies a pulse width of the output pulse which is generated on the basis of the shift pulse which is outputted from each output stage of the shift register, the switching element controlling input of the width specifying pulse by the shift pulse.

In the foregoing structure, the switching element controls input of the width specifying pulse, and since it is the shift pulse that holds such control, for example, when the switching element becomes OFF while the shift pulse is non-active, a signal line transmitting the width specifying pulse will be disconnected from the signal line driving circuit, thereby reducing capacitive load due to the signal line, and, consequently, power consumption. As a result, it is possible to realize lower power consumption and faster operation of the signal line driving circuit with ease.

In order to attain the foregoing object, an image display device of the present invention includes:

(a) a plurality of data signal lines which are disposed in a column direction;

(b) a plurality of scanning signal lines which are disposed in a row direction;

(c) a plurality of pixels, each of which is provided in an area where the data signal lines and the scanning signal lines cross each other;

(d) a data signal line driving circuit for supplying video data to the data signal lines; and (e) a scanning signal line driving circuit for supplying an output pulse as a scanning signal to the scanning signal lines, the scanning signal line driving circuit including a signal line driving circuit which is composed of a shift register having a plurality of serially connected shift circuits, each shifting an input pulse successively to the next stage based on a clock signal, and a switching element for outputting a shift pulse only in a duration of output of a width specifying pulse for specifying a width of the output pulse which is generated based on the shift pulse outputted from each stage of the shift register, the switching element controlling an input of the width specifying pulse by the shift pulse.

In the foregoing structure, since the scanning signal line driving circuit includes the signal line driving circuit, the power consumption of the scanning signal line driving circuit can be reduced. In the image display device in particular, because the proportion of the power consumption of the driving circuit is large with respect to the entire power consumption, it is effective to attain lower power consumption of the scanning line driving circuit. Additionally, in the signal line driving circuit, since capacitive load of the signal line for transmitting the width specifying pulse is reduced as described above, it is possible to broaden the operation margin. Further, miniatualization of the signal line driving circuit by reducing the number of elements is effective to reduce the size of an edge portion where the driving circuit is provided in the image display device, and consequently, an image display device with reasonable cost, low running cost and a high-performance can be provided.

Additional objects, features, and superior points of this invention will be made clear by the description below. Further, the advantages of this invention will be evident from the following explanation in reference to the drawings.

DESCRIPTION OF THE EMBODIMENTS

First Embodiment

Figure 1:
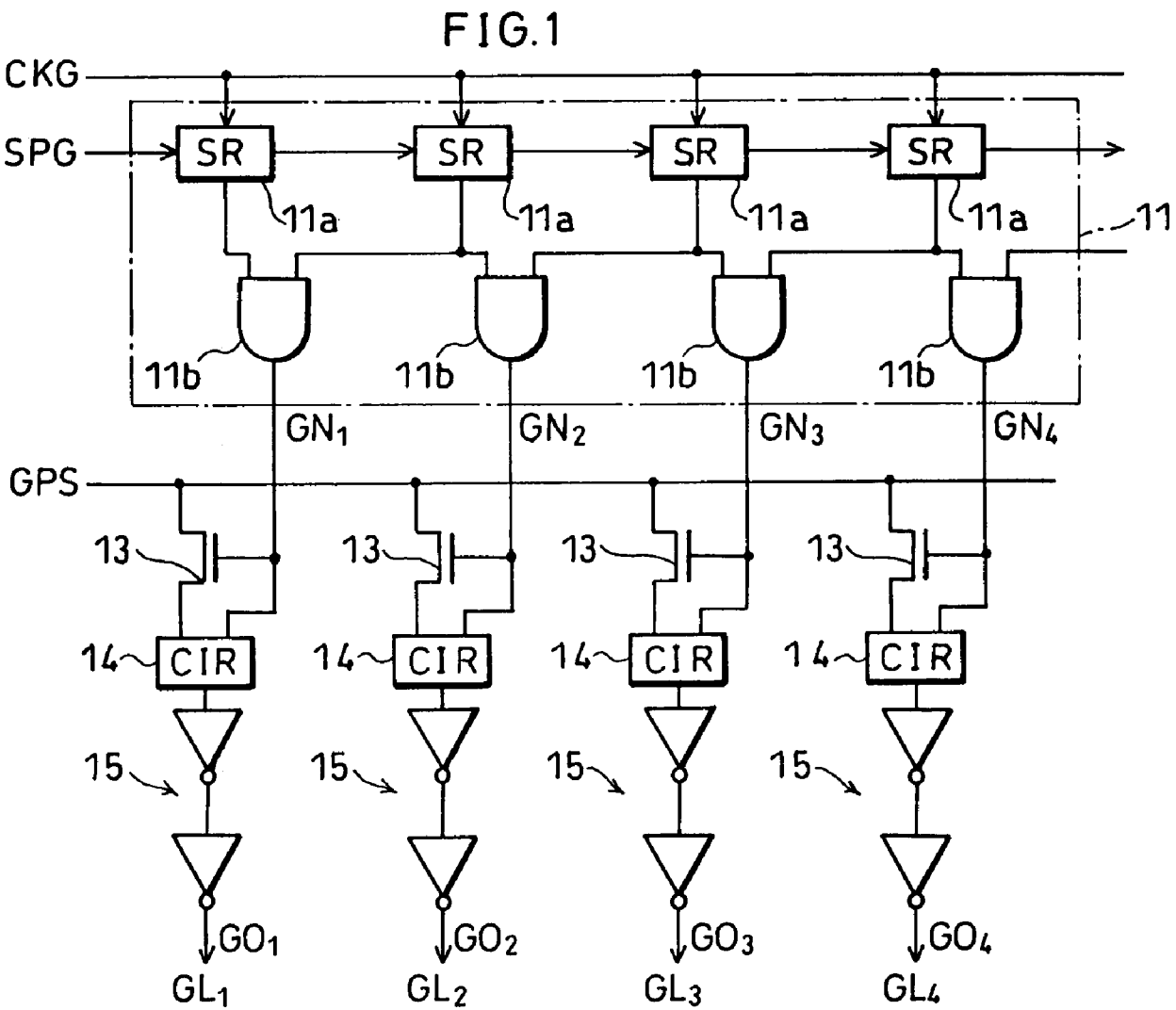
FIG. 1 is a circuit diagram showing a structure of a signal line driving circuit in accordance with the first embodiment of the present invention.
Figure 2:
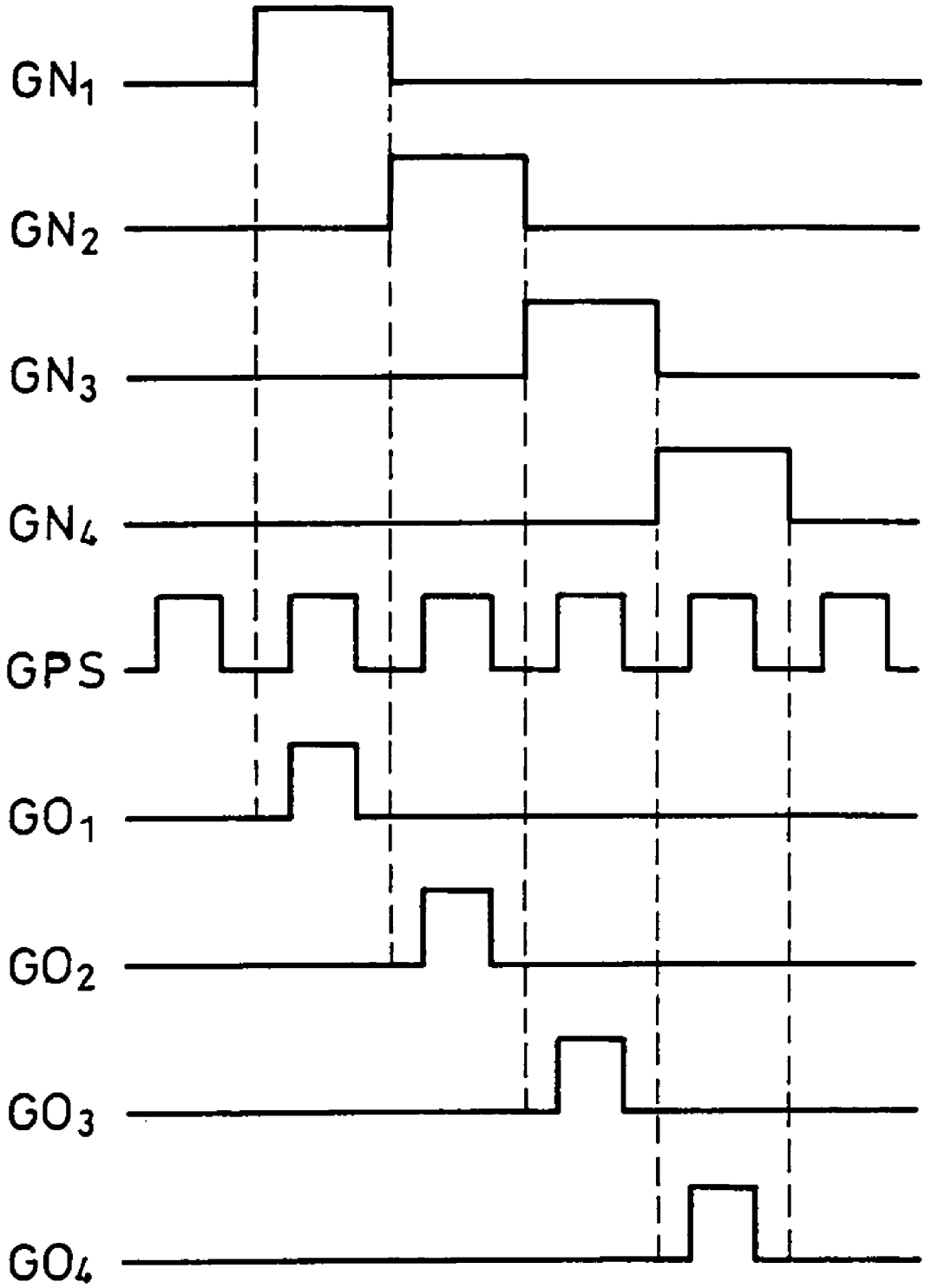
FIG. 2 is a timing chart showing an operation of the signal line driving circuit shown in FIG. 1.

The following will describe the first embodiment of the present invention with reference to FIGS. 1 and 2.

As shown in FIG. 1, the signal line driving circuit according to the present embodiment includes a shift register 11, transistors 13, logical operation circuits (CIR as illustrated) 14 and buffer circuits 15.

The shift register 11 has a plurality of shift circuits 11*a* and AND gates 11*b*, of which the shift circuits 11*a* are serially connected to one another. The shift circuit 11*a* shifts an externally inputted start pulse SPG subsequently to the shift circuit 11*a* on the next stage based on a clock signal CKG. The AND gate 11*b* outputs a logical product of the pulses outputted from two adjacent shift circuits 11*a*, as the shift pulse $GN_n$ (n=1, 2, 3 . . . ).

Note that, the shift register 11 may exclude the AND gates 11*b*. In this structure, a pulse outputted from each shift circuit 11*a* becomes the shift pulse $GN_n$.

In FIG. 1, the transistor 13 is an n-channel type electric field effect transistor. However, not limiting to this, it may also be a p-channel type electric field effect transistor or a transistor of a CMOS structure. In any case, an ON/OFF operation is controlled by the shift pulse $GN_n$. The transistor 13, as a switching element, outputs the inputted width specifying pulse GPS when in an ON state.

The logical operation circuit 14 performs an AND operation of the shift pulse $GN_n$ and the width specifying pulse GPS received from the transistor 13, and outputs a pulse (output pulse $GO_n$) whose width has been specified by the width specifying pulse GPS. The logical operation circuit 14 may be an AND gate or other circuits.

The buffer circuit 15 is provided on each output stage of the signal line driving circuit, and composed of inverters which are serially connected in two stages. The buffer circuit 15 amplifies pulses outputted from the logical operation circuit 14, and outputs them to the signal line $GL_n$ (n=1, 2, 3 . . . ) as the output line. Incidentally, this buffer circuit 15 may be made up of a single inverter.

The following will explain the operation of the signal line driving circuit structured as above, referring to a timing chart shown in FIG. 2.

First, the start pulse SPG is inputted to the shift resister 11, and it is shifted to the next stage subsequently through the shift circuits 11*a*, synchronizing with the timing of the clock signal CKG, and is outputted from each shift circuit 11*a*. The pulses outputted from two adjacent shift circuits 11*a* are received by the AND gate 11*b*, and the AND gate 11*b* outputs the AND of the pulses as the shift pulses $GN_1$, $GN_2$, $GN_3$, $GN_4$, as shown in FIG. 2.

Meanwhile, the width specifying pulse GPS of a constant period is fed into the transistors 13 while the transistors 13 are ON by the shift pulses $GN_1$, $GN_2$, $GN_3$, $GN_4$. Thereafter the logical operation circuit 14 performs an operation of an AND of the shift pulse $GN_n$ and the width specifying pulse GPS, and resultant output pulses $GO_1$, $GO_2$, $GO_3$, $GO_4$ are outputted to the signal lines $GL_1$, $GL_2$, $GL_3$, $GL_4$, respectively.

The transistor 13 is thus controlled by the shift pulse generated by the shift register 11 in the signal line driving circuit of the present embodiment. Accordingly, only the transistor 13 in which the shift pulse corresponds to an active stage is turned on while the others are turned off. Thus, the transfer signal lines, which transmit the width specifying pulse GPS are disconnected from the signal line driving circuit at nearly all stages, thereby greatly reducing capacitive load of the transfer signal lines. Consequently, the parasitic capacitance of the transfer signal lines can be reduced, and a reduction in the power consumption as well as improvement in an operational speed can readily be realized.

Second Embodiment

Figure 3:
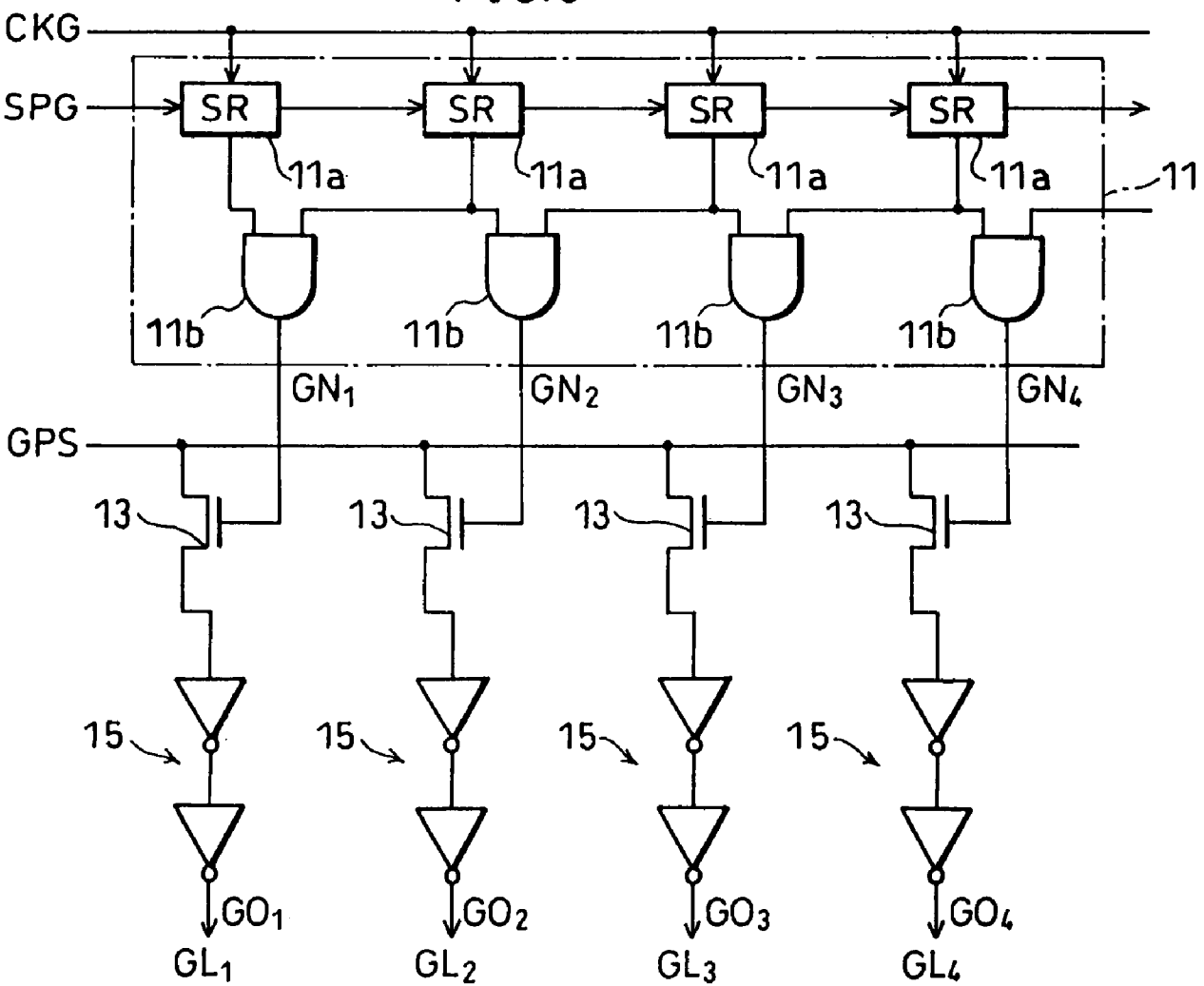
FIG. 3 is a circuit diagram showing a structure of a signal line driving circuit in accordance with the second embodiment of the present invention.

The following will explain the second embodiment of the present invention with reference to FIG. 3. Note that, for convenience of explanation, in the following embodiments including the present embodiment, the elements having the same or equivalent functions to those already discussed in the first embodiment above will be given the same reference numerals, and explanation thereof will be omitted here.

The signal line driving circuit in accordance with the present embodiment includes, as shown in FIG. 3, the shift register 11, the transistors 13 and the buffer circuits 15, as with the first embodiment. However, the logical operation circuits 14 are omitted. Specifically, the transistor 13 here is directly connected to the buffer circuit 15 without interference of the logical operation circuit 14.

With the structure as above, the width specifying pulse GPS is outputted via the transistor 13 while the transistor 13 is ON, i.e. while the shift pulse $GN_n$ is active (see FIG. 2), and thus the buffer circuit 15 receives the output pulse $GO_n$ (n=1, 2, 3, . . . ) that has been specified in accordance with the pulse width of the width specifying pulse GPS. Accordingly, the logical operation circuit 14 will not be required, and the number of the circuit elements can be reduced, in comparison with the arrangement of the first embodiment.

Figure 12:
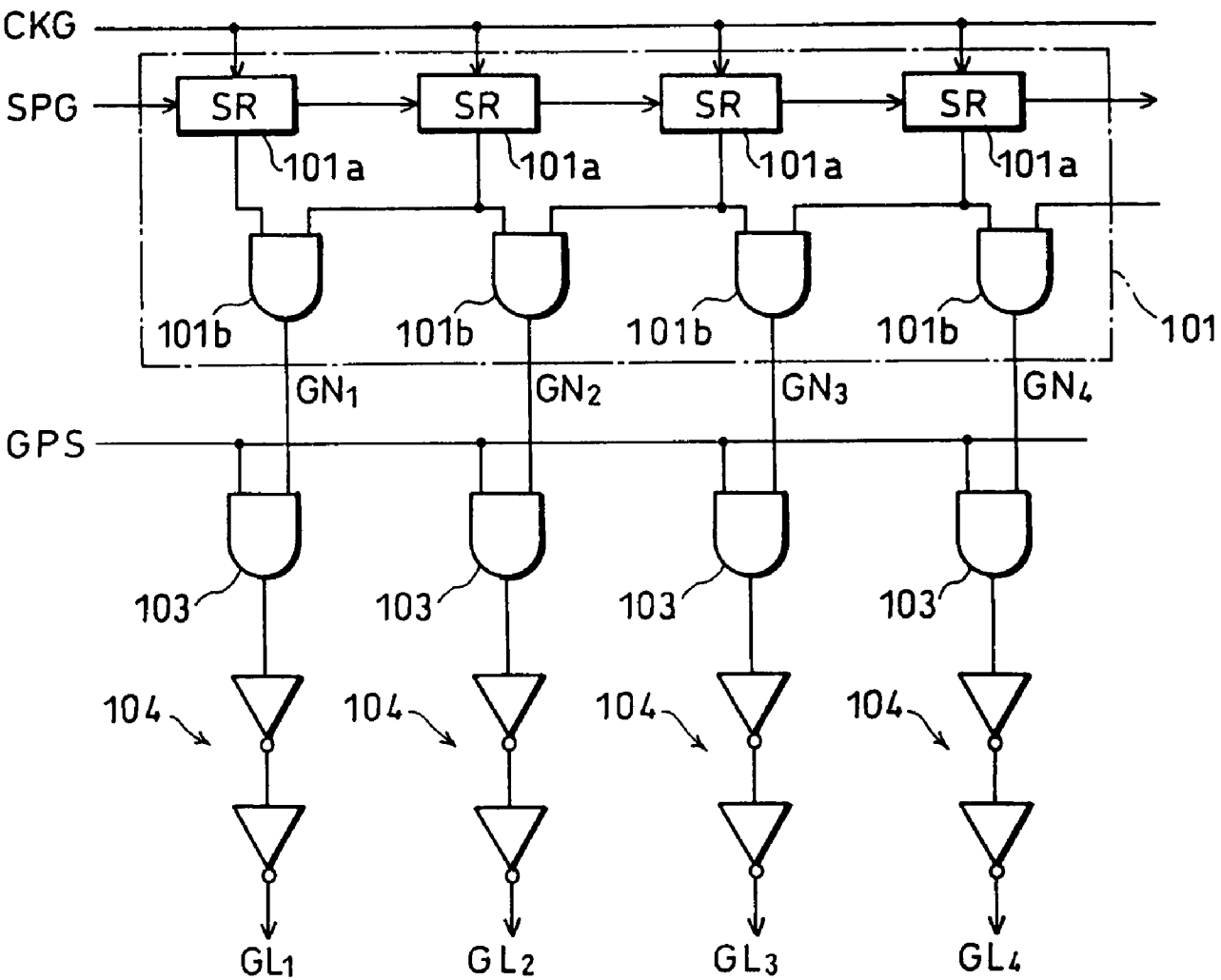
FIG. 12 (PRIOR ART)
FIG. 12 is a circuit diagram showing a structure of a scanning signal line driving circuit in the image display device of FIG. 10.
Figure 13:
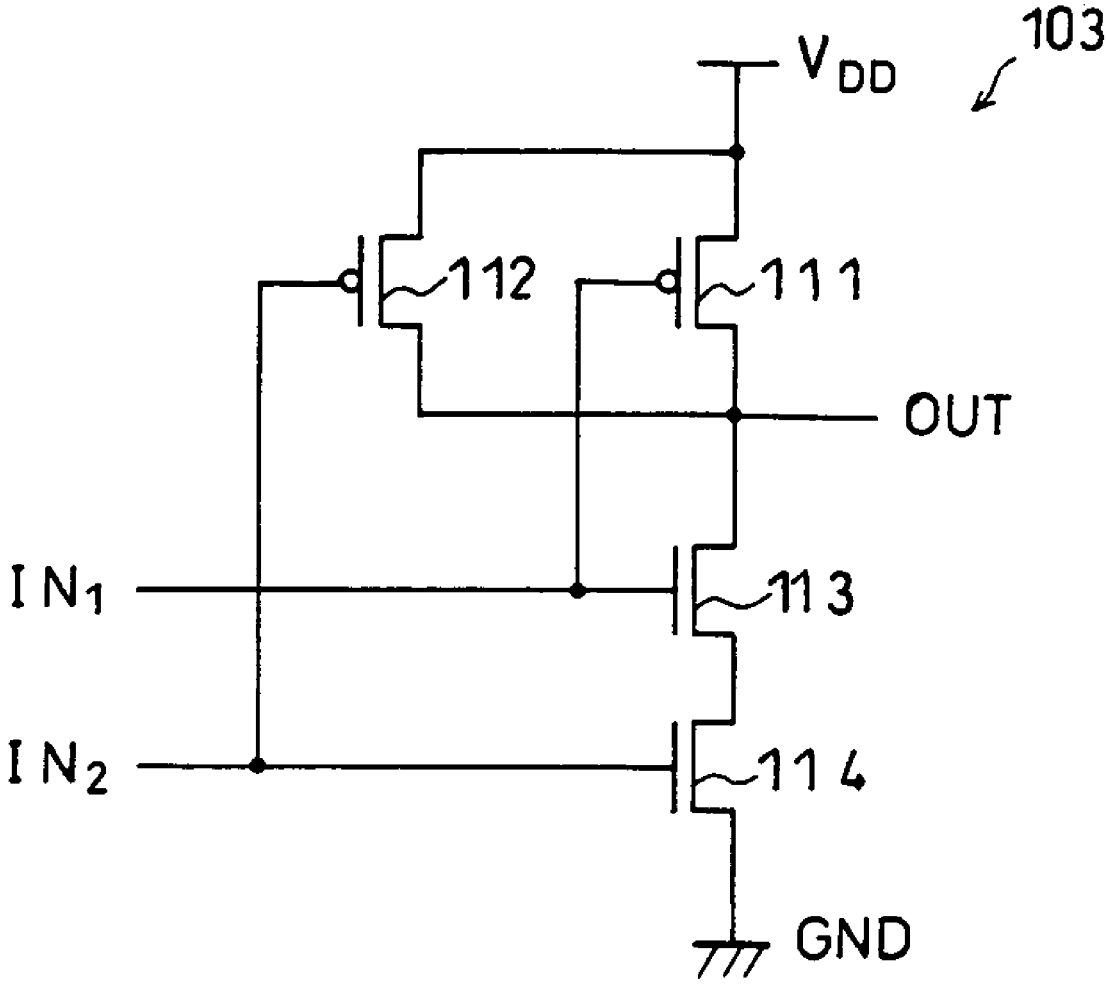
FIG.13 (PRIOR ART)
FIG. 13 is a circuit diagram showing a structure of an AND gate provided within the scanning signal line driving circuit.
Figure 14:
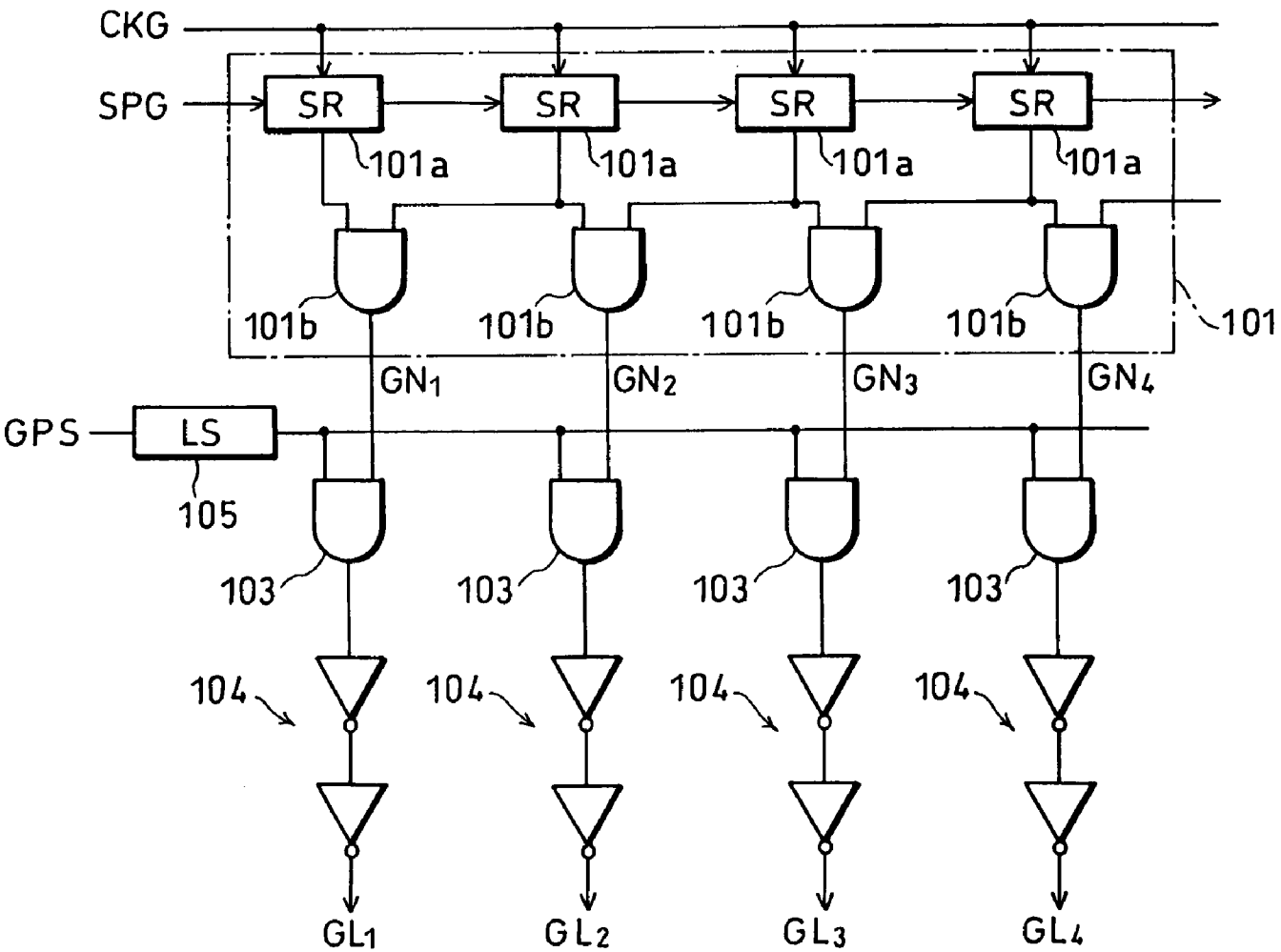
FIG. 14 (PRIOR ART)
FIG. 14 is a circuit diagram showing another structure of the scanning signal line driving circuit in the image display device of FIG. 10.

Moreover, unlike the conventional signal line driving circuits, it is not required to provide a logical gate such as the AND gate on every output stage of the shift register 11 to incorporate the width specifying pulse GPS, thereby greatly reducing the number of elements. Specifically, when the present signal line driving circuit is to be utilized in an image display device according to the seventh embodiment described below, assuming that the image display device is, for example, an XGA (i.e. extended Graphics Array) measuring 1024×768 dots and when the AND gate is adopted as is conventionally done (see FIG. 12), then it requires four transistors per stage of the shift register 11 so as to compose the AND gate. Accordingly, the total number of transistors required will be 4096 (1024×4=4096).

On the contrary, with the use of the signal line driving circuit of the present embodiment, due to the fact that every one stage of the shift register 11 requires only a single transistor 13, the total number of the transistors required will be 1024, merely a quarter of the number of the transistors required in the foregoing arrangement.

In this manner, the number of elements can be greatly reduced, thus miniatualizing the signal line driving circuit and reducing in size the edge portion including the signal line driving circuit.

Third Embodiment

Figure 4:
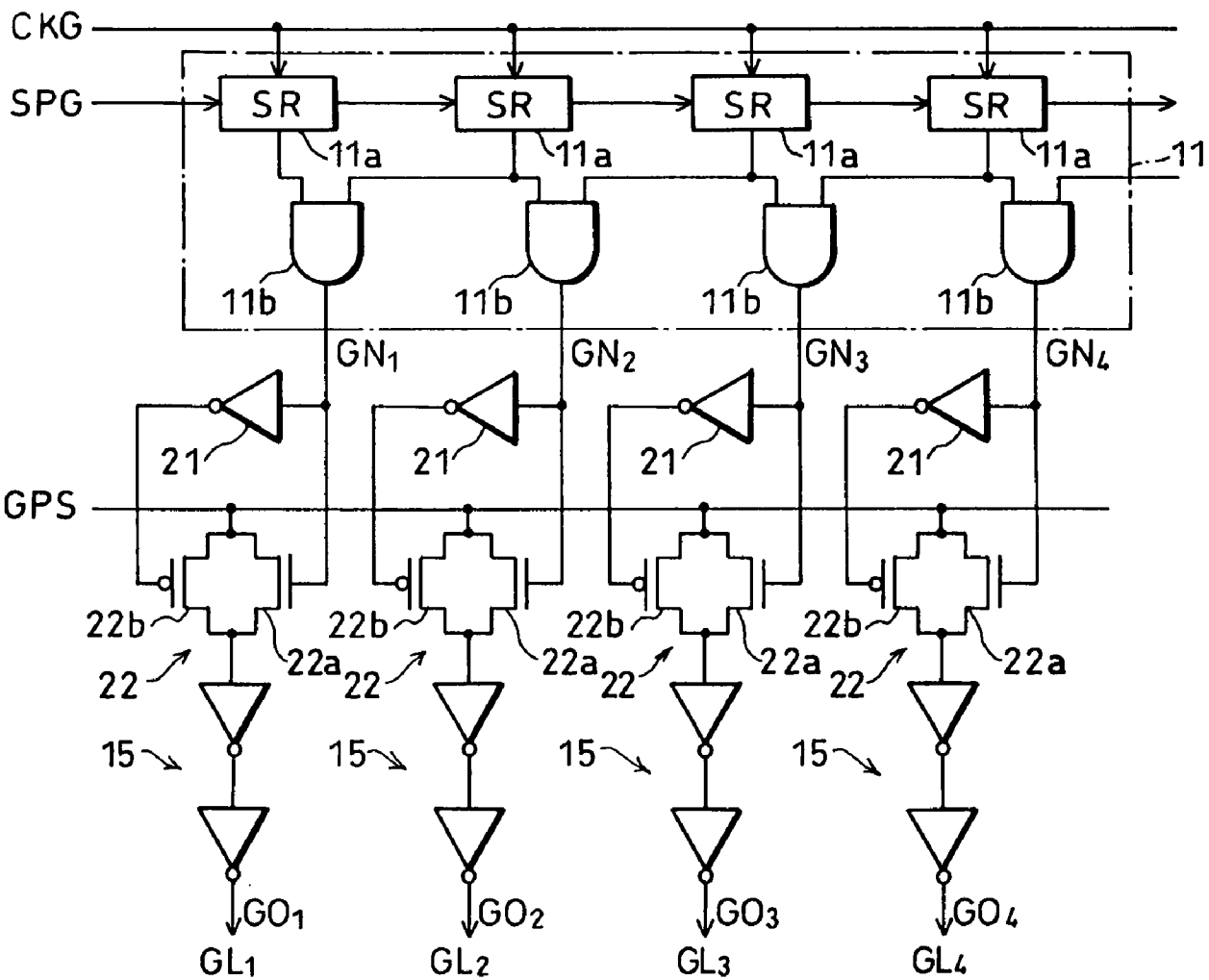
FIG. 4 is a circuit diagram showing a structure of a signal line driving circuit in accordance with the third embodiment of the present invention.

The following will explain the third embodiment of the present invention with reference to FIG. 4.

As shown in FIG. 4, the signal line driving circuit in accordance with the present embodiment includes the shift register 11, the buffer circuits 15, as with the signal line driving circuit of the first embodiment (see FIG. 1), except for inverters 21 and transfer gates 22, which are provided instead of the transistors 13 and the logical operation circuits 14.

The transfer gate 22 is a switching element of a CMOS structure, composed of an n-channel transistor 22*a* and a p-channel transistor 22*b* which are connected to each other in parallel. To the gate of the n-channel transistor 22*a* is inputted the shift pulse $GN_n$, and to the gate of the p-channel transistor 22*b* is inputted the shift pulse $GN_n$ which has been inverted by the inverter 21. Accordingly, the transfer gate 22 becomes ON when the shift pulse $GN_n$ is active, and the width specifying pulse GPS is outputted.

By thus outputting the width specifying pulse GPS by the transfer gate 22, when the transfer gate 22 is in an ON state, impedance between the input and output of the transfer gate 22 is so low that the amplitude of the width specifying pulse GPS is maintained even when it passes through the transfer gate 22. Accordingly, it is possible to greatly reduce occurrence of possible logical errors, and prevent generation of feedthrough current, which is generated when the buffer circuit 15 of the following stage receives an intermediate electric potential due to a reduction in amplitude.

Fourth Embodiment

Figure 5:
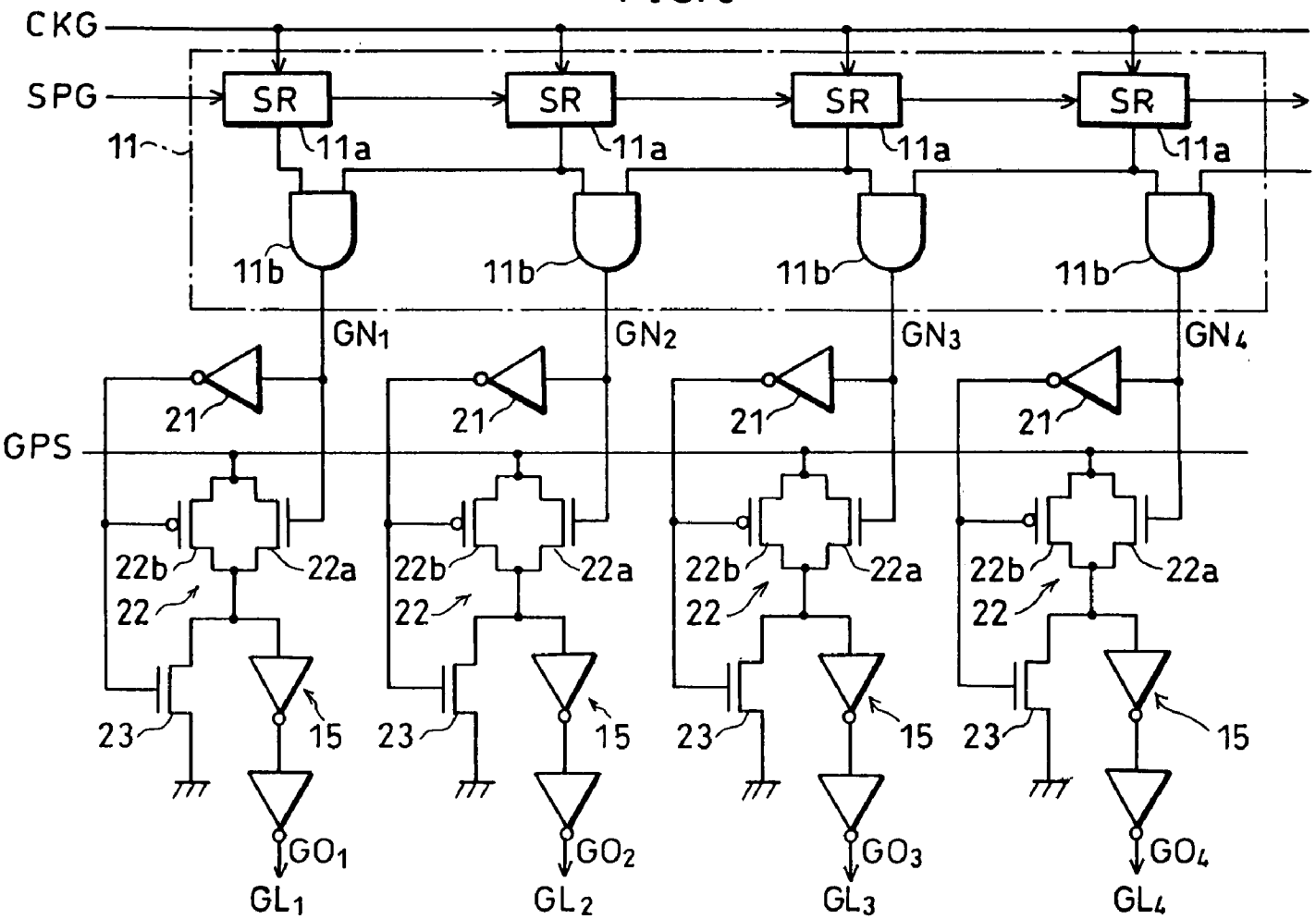
FIG. 5 is a circuit diagram showing a structure of a signal line driving circuit in accordance with the fourth embodiment of the present invention.

The following will explain the fourth embodiment of the present invention with reference to FIG. 5. Note that, for convenience of explanation, in the present embodiment, the elements having the same or equivalent functions to those already discussed in the third embodiment above will be given the same reference numerals, and explanation thereof will be omitted here.

In the signal line driving circuit of the foregoing second and third embodiments, when the shift pulse $GN_n$ generated from each output stage of the shift register 11 is non-active, the respective output nodes of the transistor 13 and the transfer gate 22 become floating state. Thus, under normal condition, these output terminals maintain a signal level determined immediately before becoming floating state. However, when there is leakage and the like on the transistors 22*a* and 22*b*, making up the transistor 13 and the transfer gate 22, a malfunction may possibly be induced by the transition of the potential level in the floating state.

In contrast, as shown in FIG. 5, the signal line driving circuit according to the present embodiment includes the shift register 11, the buffer circuits 15, the inverters 21 and the transfer gates 22 as with the third embodiment above, and additionally a transistor 23.

The transistor 23 is an n-channel type electric field effect transistor, whose ON/OFF operation is controlled by a pulse outputted from the inverter 21. The drain of the transistor 23 is connected to the output terminal of the transfer gate 22, and the gate thereof is grounded.

In the structure as above, the output node of the transfer gate 22 is grounded when the shift pulse $GN_n$ is non-active, and there will be no fluctuation of the potential as described above. Accordingly, the malfunction due to the floating state can be avoided.

Fifth Embodiment

Figure 6:
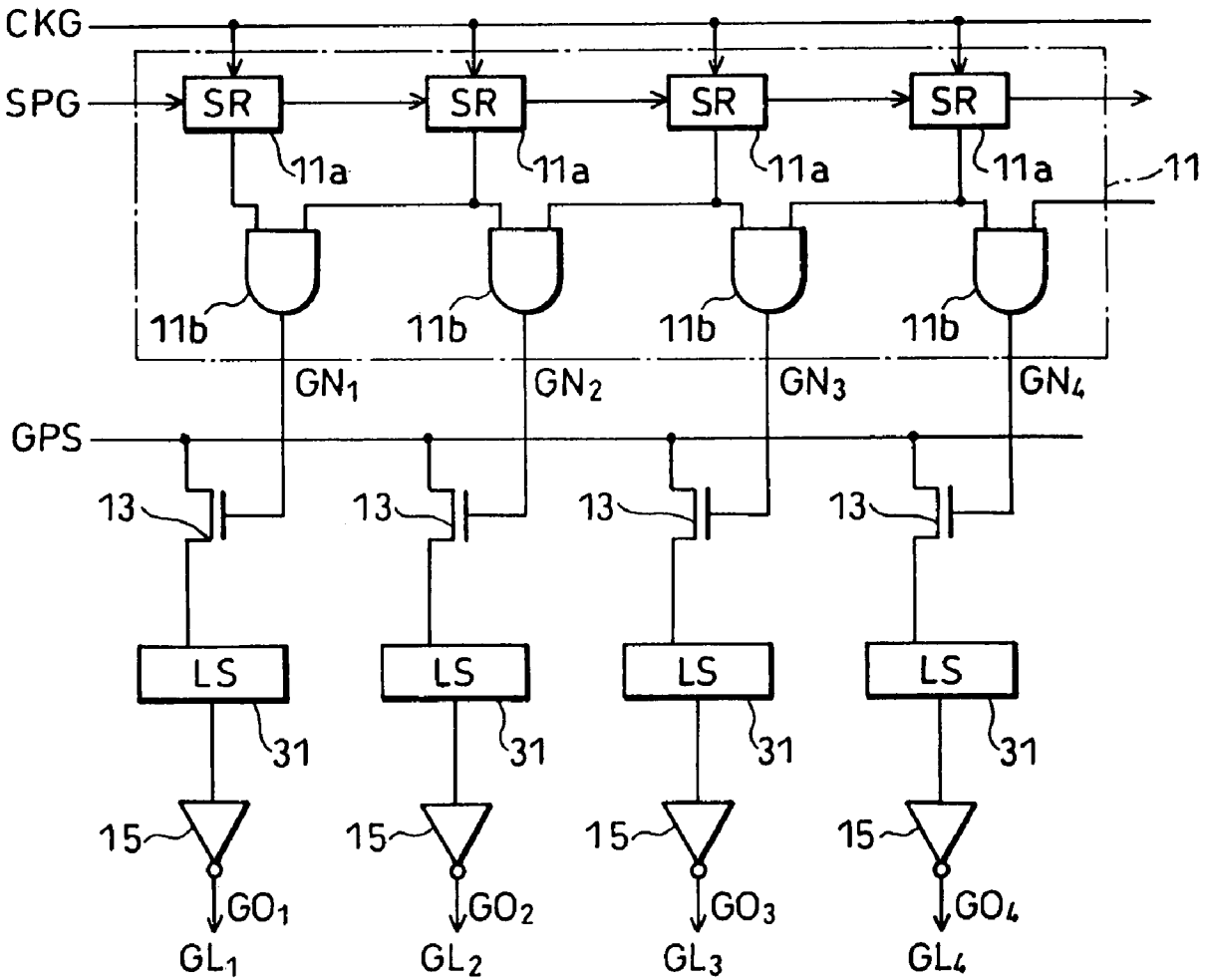
FIG. 6 is a circuit diagram showing a structure of a signal line driving circuit in accordance with the fifth embodiment of the present invention.

The following will explain the fifth embodiment of the present invention with reference to FIG. 6.

As shown in FIG. 6, the signal line driving circuit according to the present embodiment includes the shift register 11, the transistors 13 and the buffer circuits 15, as with the signal line driving circuit of the second embodiment discussed above (see FIG. 3), and additionally level shifters 31. The level shifter 31 as a level shifter circuit is provided between the transistor 13 and the buffer circuit 15. Normally, this level shifter 31 shifts the level of the amplitude value of the width specifying pulse GPS, which is lower than the power voltage of the signal line driving circuit, so as to increase it to the level of the power voltage to be applied to the signal line driving circuit.

In the structure as above, since the level shifter 31 increases the amplitude of the width specifying pulse GPS, the amplitude is sufficiently maintained so that the amplitude of the outputted pulse directed to the buffer circuit 15 will not cause malfunction even when the amplitude of the width specifying pulse GPS is reduced when passing through the transistor 13. Accordingly, a desired performance can be ensured without using the transfer gate 22 as in the third and fourth embodiments above.

Sixth Embodiment

Figure 7:
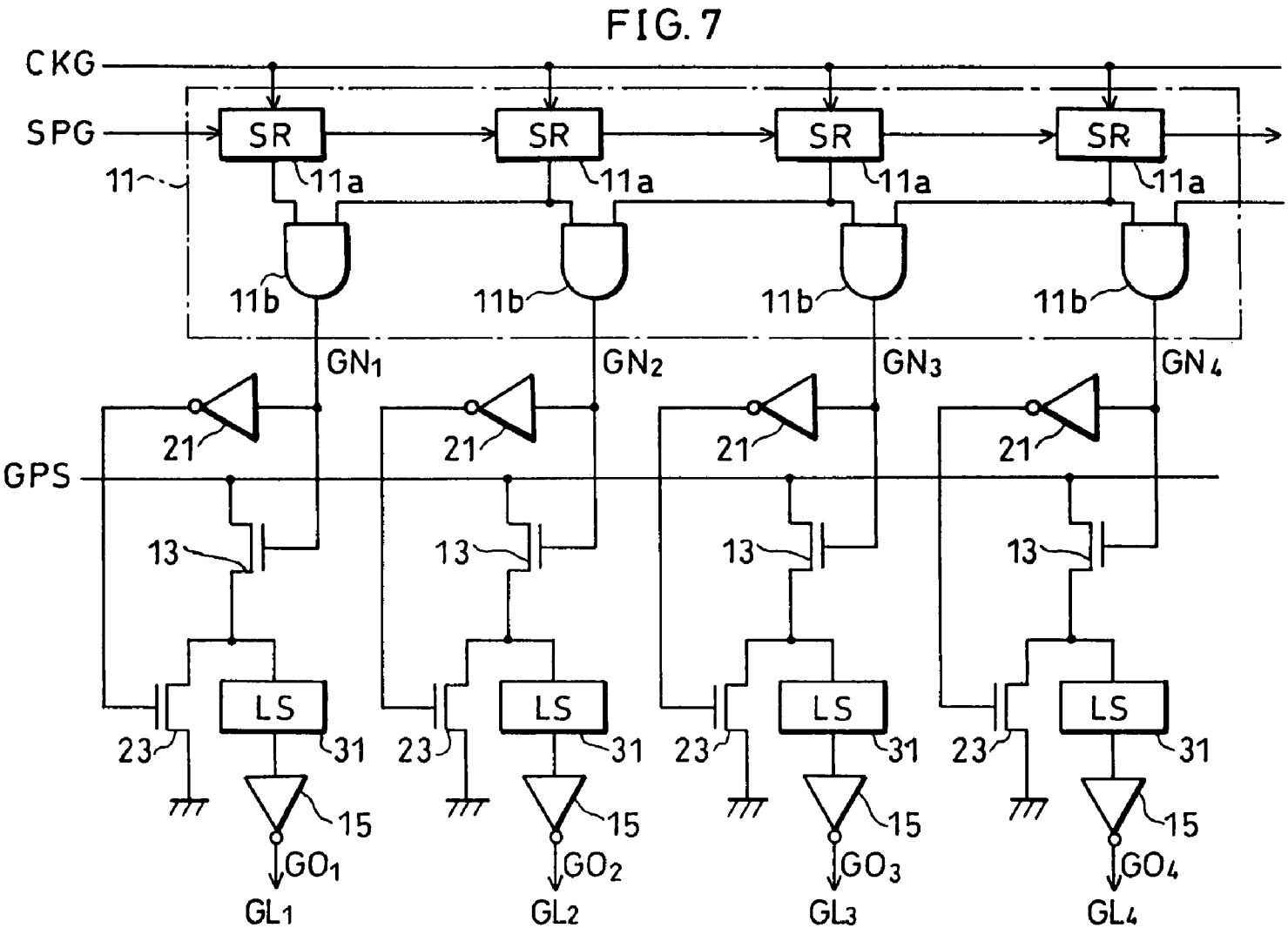
FIG. 7 is a circuit diagram showing a structure of a signal line driving circuit in accordance with the sixth embodiment of the present invention.
Figure 8:
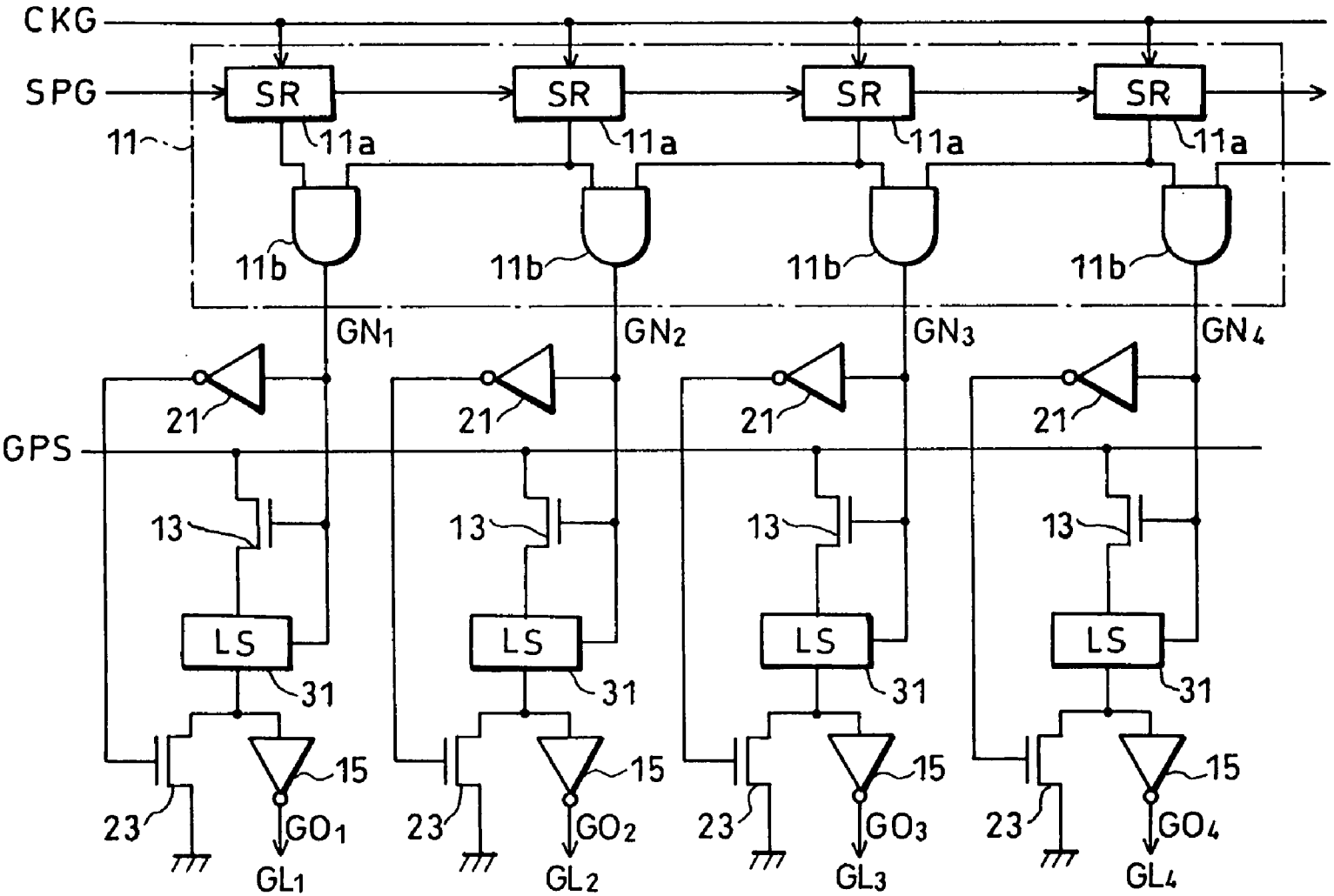
FIG. 8 is a circuit diagram showing a structure of a signal line driving circuit in accordance with a modification example of the sixth embodiment of the present invention.

The following will explain the sixth embodiment of the present invention with reference to FIGS. 7 and 8. Note that, for convenience of explanation in the present embodiment, the elements having the same or equivalent functions to those already discussed in the fourth and fifth embodiments above will be given the same reference numerals, and explanation thereof will be omitted here.

As shown in FIG. 7, the signal line driving circuit according to the present embodiment includes the shift register 11, the transistors 13, the buffer circuits 15 and the level shifters 31 as with the signal line driving circuit of the fifth embodiment above (see FIG. 6). Additionally, it further includes the inverters 21 and the transistors 23 as with the signal line driving circuit of the fourth embodiment. The drain of the transistor 23 discussed here is connected to the output terminal of the transistor 13.

In the structure as above, the output node of the transistor 13 is grounded when the shift pulse $GN_n$ is non-active, and there will be no fluctuation of the potential of the output node of the transistor 13, and thus malfunction of the signal line driving circuit can be prevented.

Moreover, as shown in FIG. 8, the signal line driving circuit according to a modification example of the present embodiment is arranged to control the operation of the level shifters 31 by the shift pulse $GN_n$. Specifically, the level shifter 31 operates while the shift pulse $GN_n$ is active, and the level shifter 31 does not operate while the shift pulse $GN_n$ is non-active. Therefore, the level shifter 31 is provided with, for instance, a transistor which conducts or cuts off a power supply path within the level shifter 31. Further, the arrangement for controlling the operation of the level shifter 31 is not limited to the above, but any other appropriate circuits may be used therefor.

In this manner, by controlling the operation of the level shifter 31 by the shift pulse $GN_n$, the level shifter 31 of a stage in which the shift pulse $GN_n$ is non-active do not operate, thereby greatly reducing power consumption associated with the level shifter 31.

Seventh Embodiment

Figure 9:
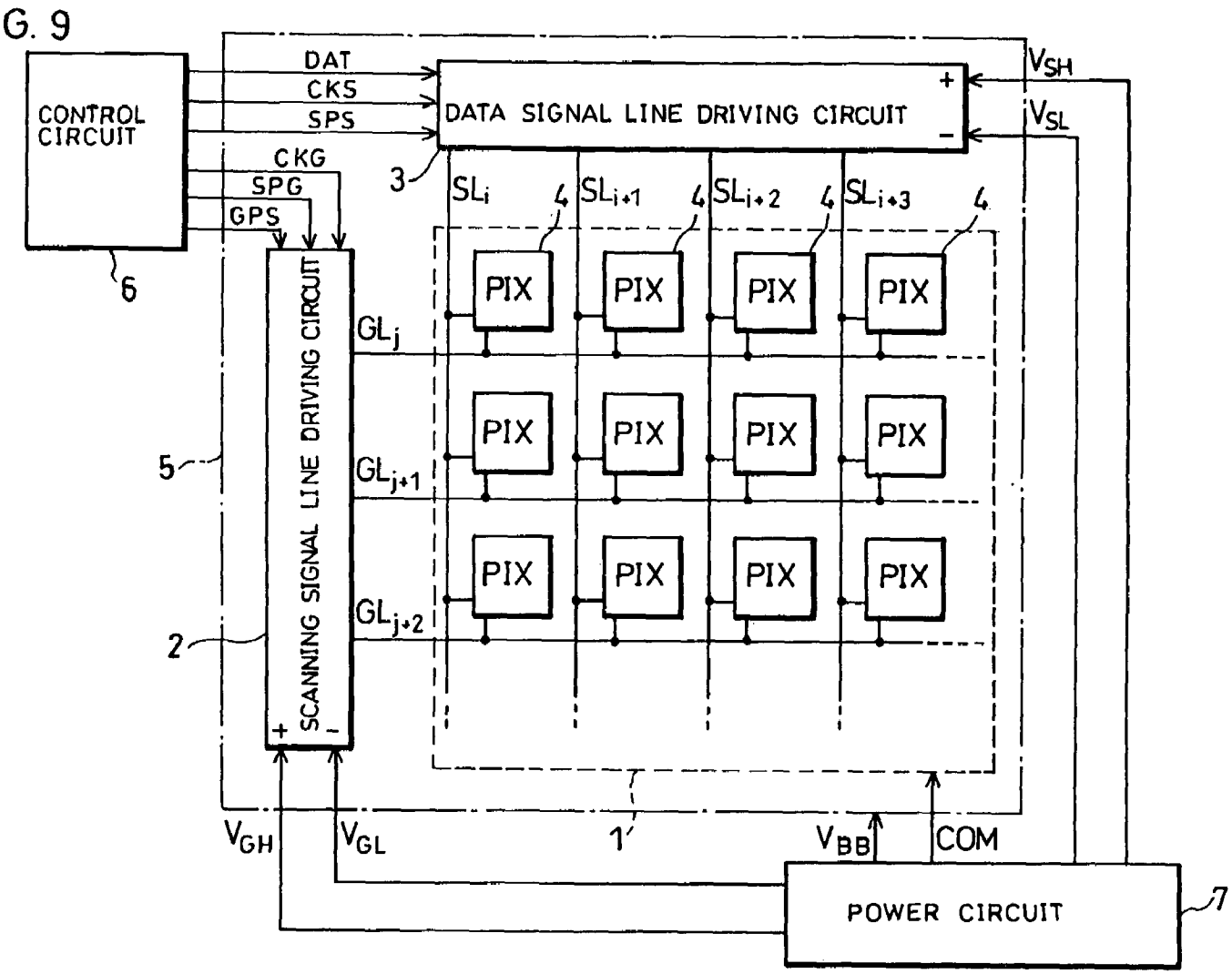
FIG. 9 is a circuit diagram showing a structure of an image display device in accordance with the seventh embodiment of the present invention.

The following will explain the seventh embodiment of the present invention with reference to FIG. 9.

As shown in FIG. 9, an image display device according to the present embodiment includes the pixel array 1, the scanning signal line driving circuit 2, the data signal line driving circuit 3, a control circuit 6 and a power circuit 7, and of which the pixel array 1, the scanning signal line driving circuit 2 and the data signal line driving circuit 3 are integrally formed on the substrate 5.

In recent years, in order to realize the miniatualization of image display devices, improvement in reliability, and reduction of costs etc., a focus of attention has been a technique in which the scanning signal line driving circuit 2 and the data signal line driving circuit 3 are formed on the substrate 5 integrally with the pixel array 1, as discussed above. In such driving-circuit-integrated-type image display devices, and particularly in liquid crystal display devices (i.e. transmissive-type liquid crystal display devices widely used nowadays), it is required that the substrate 5 be made of a transparent material, and for this reason, a polycrystalline silicon thin-film transistor, which can be formed on a quartz substrate or a glass substrate, is frequently utilized as an active element.

Figure 10:
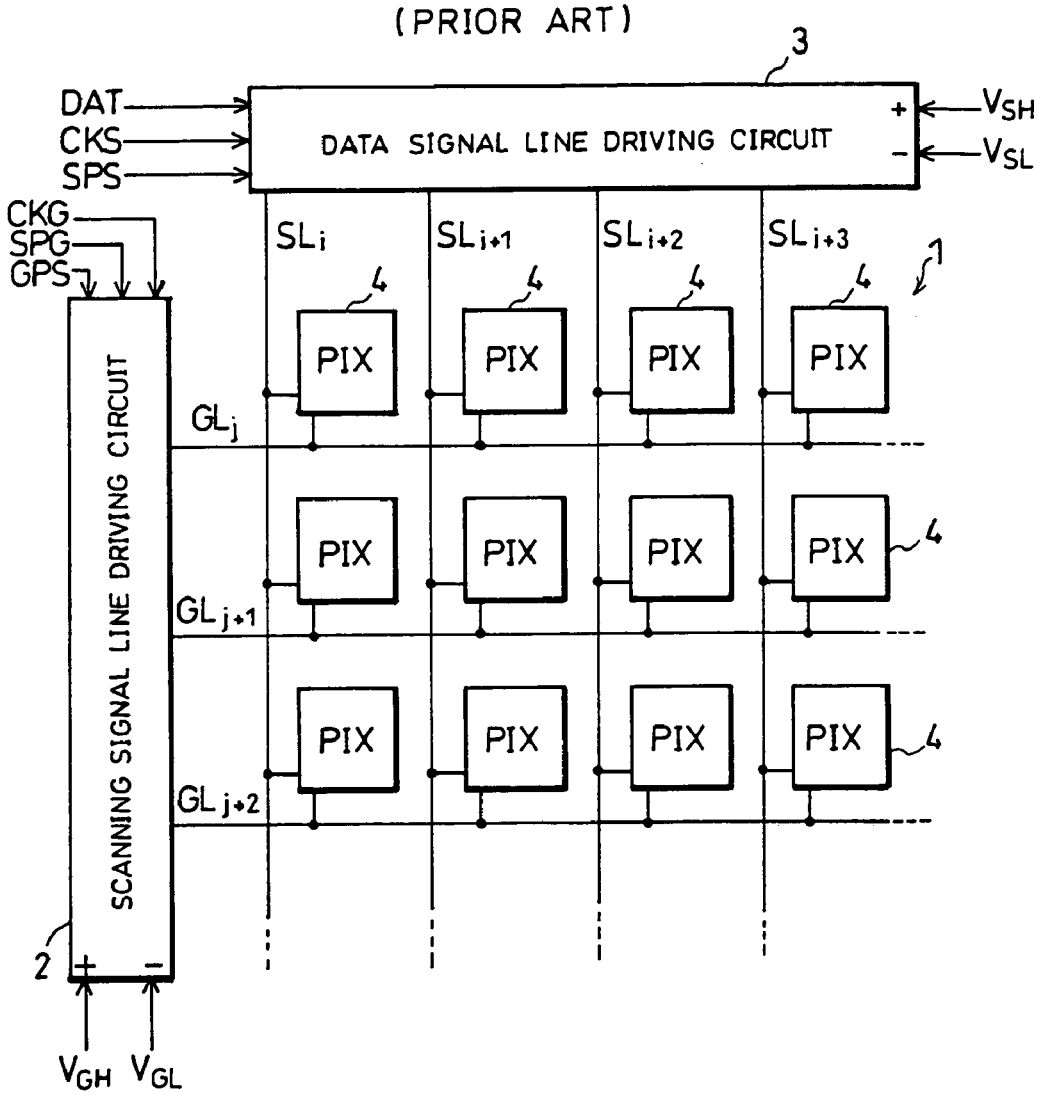
FIG.10 (PRIOR ART)
FIG. 10 is a circuit diagram showing a structure of a conventional image display device.
Figure 11:
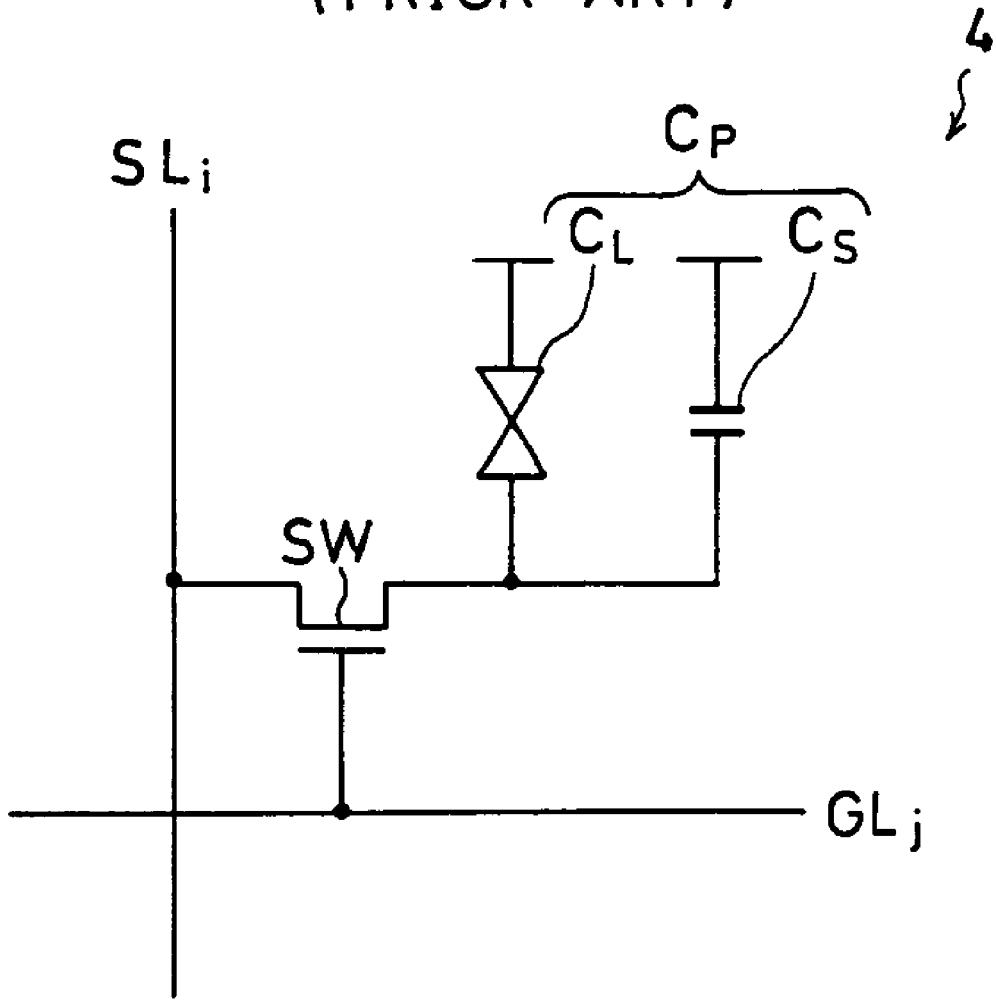
FIG. 11 (PRIOR ART)
FIG. 11 is a circuit diagram showing a structure of pixel in the image display device of FIG. 10.

The substrate 5 is made of insulating as well as transmissive materials such as glass. The pixel array 1 includes the data signal lines SL, the scanning signal lines GL and the pixel 4 as with the conventional image display devices (see FIG. 10).

The scanning signal line driving circuit 2 generates scanning signals to be given to scanning signal lines $GL_j$, $GL_{j+1}$ that are connected to the pixels of corresponding rows, based on the clock signal CKG, the width specifying pulse GPS and the start pulse SPG, which are all received from the control circuit 6. Further, the data signal line driving circuit 3 samples video signal DAT (graphic data) supplied from the control circuit 6, based on the clock signal CKS and the start pulse SPS from the control circuit 6, and outputs the sampled data to data signal lines $SL_i$, $SL_{i+1}$ which are connected to the pixels of corresponding columns.

The power circuit 7 generates power voltages $V_{SH}$, $V_{SL}$, $V_{GH}$, $V_{GL}$ and ground potential COM. The power voltages $V_{SH}$ and $V_{SL}$ have a different voltage level, and are supplied to the data signal line driving circuit 3. The power voltages $V_{GH}$ and $V_{GL}$ have a different voltage level, and are supplied to the scanning signal line driving circuit 2. The ground potential COM is supplied to a common electrode line (not illustrated) that is provided on the substrate 5.

The scanning signal line driving circuit 2 includes either one of the foregoing signal line driving circuits of the first through sixth embodiments.

In the present embodiment, the scanning signal line driving circuit 2 includes the signal line driving circuit according to the present invention as noted above. Thus, when the shift pulse $GN_n$ is non-active, either the transistor 13 or the transfer gate 22 becomes an OFF state, which causes the signal lines transmitting the width specifying pulse GPS to be disconnected from the signal line driving circuit, thus greatly reducing the capacitive load of the signal lines. Accordingly, it is possible to increase the operation margin of the image display device. Furthermore, because the number of elements (transistors) can be greatly reduced, the size of the scanning signal line driving circuit 2 can be reduced, thereby reducing the size of the edge portion in the vicinity of the pixel array 1 including the scanning signal line driving circuit 2. Consequently, miniatualization of image display devices can be realized with ease.

As described, the signal line driving circuit of the present invention includes a shift register having a plurality of serially connected shift circuits each of which shifts an input pulse successively to the next stage based on a clock signal, and outputs a shift pulse as an output pulse to a plurality of output lines only in a duration of output of a width specifying pulse for specifying a width of the output pulse which is generated based on the shift pulse outputted from each output stage of the shift register, and the signal line driving circuit further includes a switching element, for example, such as a transistor or a transfer gate, which controls input of the width specifying pulse by the shift pulse.

In the foregoing structure, the switching element controls input of the width specifying pulse, and since it is the shift pulse that holds such control, for example, when the switching element becomes OFF state while the shift pulse is non-active, a signal line transmitting the width specifying pulse will be disconnected from the signal line driving circuit, thereby reducing capacitive load due to the signal line, and, consequently, power consumption. As a result, it is possible to realize lower power consumption and faster operation of the signal line driving circuit.

Further, it is preferable in the signal line driving circuit of the present invention that the switching element inputs the width specifying pulse when in an ON state. In this structure, while the switching element is in an ON state, i.e. while the shift pulse is active, the width specifying pulse is inputted via the switching element. Accordingly, by using the switching element having a simple structure in place of the AND gate, which has been used in a conventional structure in which the output pulse width has been specified by the width specifying pulse (see FIG. 12), the output pulse whose pulse width has been specified by the width specifying pulse can be obtained. Consequently, the number of elements will be greatly reduced, thereby miniatualizing the signal line driving circuit with ease.

Further, the signal line driving circuit of the present invention preferably includes a level shifter circuit for increasing the amplitude of the width specifying pulse that is smaller than that of the output pulse, the level shifter circuit being provided on an output side of the switching element.

In this structure, since the level shifter circuit is provided on the output side of the switching element, even the amplitude of a width specifying pulse with a small amplitude can be increased as it passes through the switching element. Accordingly, the output pulse is not generated at such a low level as to cause malfunction within the signal line driving circuit, thus ensuring stable operation. Further, because the width specifying pulses of a small amplitude are supplied to each switching element via signal lines that transmit the width specifying pulse, power consumption due to these signal lines can be reduced.

Furthermore, it is preferable in the signal line driving circuit according to the present invention that the operation of the foregoing level transforming circuit be controlled by the shift pulse.

In the foregoing structure, for example, by operating the level shifter circuit when the shift pulse is active, and by not operating the level shifter circuit when the shift pulse is non-active, it will be possible to operate only the level shifter circuit to which an activated shift pulse is inputted, thereby further reducing power consumption.

The image display device according to the present invention includes: (a) a plurality of data signal lines which are disposed in a column direction; (b) a plurality of scanning signal lines which are disposed in a row direction; (c) a plurality of pixels, each of which is provided in an area where data signal lines and scanning signal lines cross each other; (d) the data signal line driving circuit for supplying video data to the data signal lines; and (e) the scanning signal line driving circuit for supplying the scanning signal to the scanning signal lines; wherein the scanning signal line driving circuit includes any one of the foregoing signal line driving circuits.

In the foregoing structure, since the scanning signal line driving circuit includes the signal line driving circuit, the power consumption of the scanning signal line driving circuit can be reduced. In the image display device in particular, because the proportion of the power consumption of the driving circuit is large with respect to the entire power consumption, it is effective to attain lower power consumption of the scanning line driving circuit. Additionally, in the signal line driving circuit, since capacitive load of the signal line for transmitting the width specifying pulse is reduced as described above, it is possible to broaden the operation margin. Further, miniatualization of the signal line driving circuit by reducing the number of elements is effective to reduce the size of an edge portion where the driving circuit is provided in the image display device, and consequently, an image display device with reasonable cost, low running cost and a high-performance can be provided.

The concrete embodiments and examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. A signal line driving circuit which outputs an output pulse to a plurality of output lines comprising:

a shift register having a plurality of serially connected shift circuits, each shifting an input pulse successively to a next stage based on a clock signal;

a switching element for outputting a width specifying pulse during an output period of a shift pulse, said shift pulse being outputted from a shift register, said width specifying pulse specifying a pulse width of the output pulse which is generated based on the shift pulse, wherein the switching element controls input of the width specifying pulse according to the shift pulse; and a logical operation circuit for performing a logical operation of the shift pulse and an output of the switching element.

2. The signal line driving circuit according to claim 1, wherein the switching element is a field effect transistor.

3. The signal line driving circuit according to claim 2, wherein the switching element in an ON state inputs the width specifying pulse.

4. An image display device of an active matrix type, comprising:

a plurality of data signal lines which are disposed in a column direction;

a plurality of scanning signal lines which are disposed in a row direction;

a plurality of pixels, each of which is provided in an area where the data signal lines and the scanning signal lines cross each other;

a data signal line driving circuit for supplying video data to the data signal lines; and a scanning signal line driving circuit for supplying an output pulse as a scanning signal to the scanning signal lines, the scanning signal line driving circuit including a signal line driving circuit which is composed of a shift register having a plurality of serially connected shift circuits, each shifting an input pulse successively to a next stage based on a clock signal, a switching element for outputting a width specifying pulse only during an output period of a shift pulse, said shift pulse being outputted from an output stage of a shift register, said width specifying pulse specifying a pulse width of the output pulse which is generated based on the shift pulse, wherein the switching element controls an input of the width specifying pulse according to the shift pulse, and a logical operation circuit for performing a logical operation on the shift pulse and an output of the switching element.

5. The image display device according to claim 4, wherein the switching element is a field effect transistor.

6. The image display device according to claim 5, wherein the switching element in an ON state inputs the width specifying pulse.

* * * * *